US007082774B2

(12) United States Patent
Ayub

(10) Patent No.: US 7,082,774 B2
(45) Date of Patent: Aug. 1, 2006

(54) COMPRESSOR OIL REMOVAL IN AMMONIA REFRIGERATION SYSTEM

(76) Inventor: Zahid Hussain Ayub, 3305 Thorntree Ct., Arlington, TX (US) 76016

( * ) Notice: Subject to any disclaimer, the term of this patent is extended or adjusted under 35 U.S.C. 154(b) by 0 days.

(21) Appl. No.: 10/648,227

(22) Filed: Aug. 27, 2003

(65) Prior Publication Data

US 2005/0044879 A1 Mar. 3, 2005

(51) Int. Cl.
*F25B 43/02* (2006.01)

(52) U.S. Cl. ..... 62/84; 62/193; 62/470; 73/53.05

(58) Field of Classification Search ..... 62/470, 62/471, 194, 193, 84; 210/168; 73/53.05; 340/622

See application file for complete search history.

(56) References Cited

U.S. PATENT DOCUMENTS 3,850,009 A * 11/1974 Villadsen ..... 62/473
4,280,337 A 7/1981 Kemp
4,563,780 A * 1/1986 Pollack ..... 4/668
4,872,316 A * 10/1989 Browne et al. ..... 62/129
5,103,648 A * 4/1992 Barbier ..... 62/126
5,321,956 A * 6/1994 Kemp et al. ..... 62/193
5,514,595 A * 5/1996 Olds et al. ..... 436/126
5,531,080 A * 7/1996 Hirahara et al. ..... 62/470
6,125,642 A * 10/2000 Seener et al. ..... 62/193
6,505,523 B1 * 1/2003 Taylor et al. ..... 73/863.01
6,718,819 B1 * 4/2004 Schoess ..... 73/53.05

OTHER PUBLICATIONS

Sporlan Valve Company, Level Master Control, Bulletin 60-15, Sep. 1990, St. Louis, MO 63143.

* cited by examiner

*Primary Examiner*—William E. Tapolcai
(74) *Attorney, Agent, or Firm*—Geoffrey A. Mantooth

(57) ABSTRACT

Automatic oil removal from an ammonia evaporator/low pressure vessel in a refrigeration system is disclosed. A liquid refrigerant level controller is utilized to drain the oil. The controller works under the principle of fluid thermal conductivity. Oil having lower thermal conductivity as compared to liquid ammonia, activates the probe which in turn opens the valve to drain the oil accumulated in a trap of an evaporator or a low pressure vessel.

5 Claims, 3 Drawing Sheets

COMPRESSOR OIL REMOVAL IN AMMONIA REFRIGERATION SYSTEM

FIELD OF INVENTION

The present invention relates to compressor oil removal method for evaporators and/or low-pressure vessels in an ammonia refrigeration system.

BACKGROUND OF THE INVENTION

An evaporator and/or a low-pressure vessel are an integral part of a refrigeration system. In a typical ammonia refrigeration system there is an evaporator that cools the process fluid at the expense of boiling the refrigerant that is at a lower saturation temperature and pressure, a compressor that compresses the boiled off refrigerant to an elevated pressure and temperature, a condenser that condenses the high pressure refrigerant to liquid phase at the expense of heating the cooling medium, and an expansion device that drops down the pressure of the condensed refrigerant back to the low side which then enters the evaporator to repeat the above cycle again. This cycle is called the reverse Rankine cycle.

Compressor is an integral and important part of this cycle. Compressor is also the major moving part in this cycle; therefore, it requires lubrication to overcome the friction between metal parts rubbing against each other. Certain quantity of this lubricant, which is generally mineral oil in an ammonia refrigeration system, escapes to other parts of the system. Generally the lubrication oil accumulates in the coldest part, i.e., the evaporator or a low-pressure vessel such as the recirculator vessel. Ammonia is evaporated in the evaporator but the oil does not boil off and remains as a liquid. There are three negative aspects of this oil migration and accumulation. Firstly, the compressor can eventually starve of oil and be damaged. Secondly, the financial loss due to constant replenishment and thirdly, large quantity of oil in the evaporator results in negative effect on the heat transfer characteristics of evaporator tubes or plates. Therefore, it is important that this oil be removed.

Several methods have been proposed and disclosed in previous patents such as U.S. Pat. No. 4,280,337 and U.S. Pat. No. 5,321,956 in which uses of various, pipes, valves and hold tanks is used. In the cited patents it is shown that the oil drainage is not a function of the amount of oil present in the evaporator or a vessel rather the oil is purged at a set time for a set period.

SUMMARY OF THE INVENTION

It is the object of the present invention to provide an automatic oil removal method for an industrial refrigeration system, especially with ammonia as a refrigerant. It is also another object of the present invention to provide an economical and efficient oil removal system for a flooded evaporator or a low-pressure vessel.

In a flooded refrigeration system, the evaporator is either shell and tube or plate and frame or shell & plate. Low-pressure ammonia enters the evaporator after passing through the expansion device. As mentioned earlier, some oil migrates to the evaporator or a low-pressure vessel and eventually accumulates there. If not removed it could hamper the heat transfer and hence, reduce the efficiency of the entire system. In order to eliminate this problem, it is proposed that a liquid refrigerant level controller such as one manufactured by Sporlan Valve Company of St. Louis be used. This valve is offered by Sporlan as a liquid level controller for a flooded evaporator or a low-pressure vessel. It works on the principle of thermal conductivity of the fluid. Liquid refrigerant has higher thermal conductivity compared to refrigerant vapor, hence, when liquid refrigerant level drops, the probe of the level controller is in contact with the vapor phase only which has a lower thermal conductivity as compared to the liquid phase of the refrigerant, therefore, the probe actuates the accompanying valve to allow the liquid refrigerant to enter the flooded evaporator or a low pressure receiver. After the probe is fully immersed in the liquid refrigerant, it feeds a signal to the accompanying valve to close; hence the flow of the liquid refrigerant is stopped momentarily. This process is repeated regularly, hence automatically maintaining a fairly steady liquid level during operation of the system. In this invention the principle of varying thermal conductivity between the oil and the liquid refrigerant is utilized to remove oil automatically from an ammonia evaporator/low pressure receiver with such a probe/valve combination. Here the oil acts like a refrigerant vapor since it has a similar thermal conductivity as the vapor phase of ammonia. In this case the valve is connected in reverse to allow outward flow rather than inward flow.

DESCRIPTION OF THE PREFERRED EMBODIMENT

Figure 1:
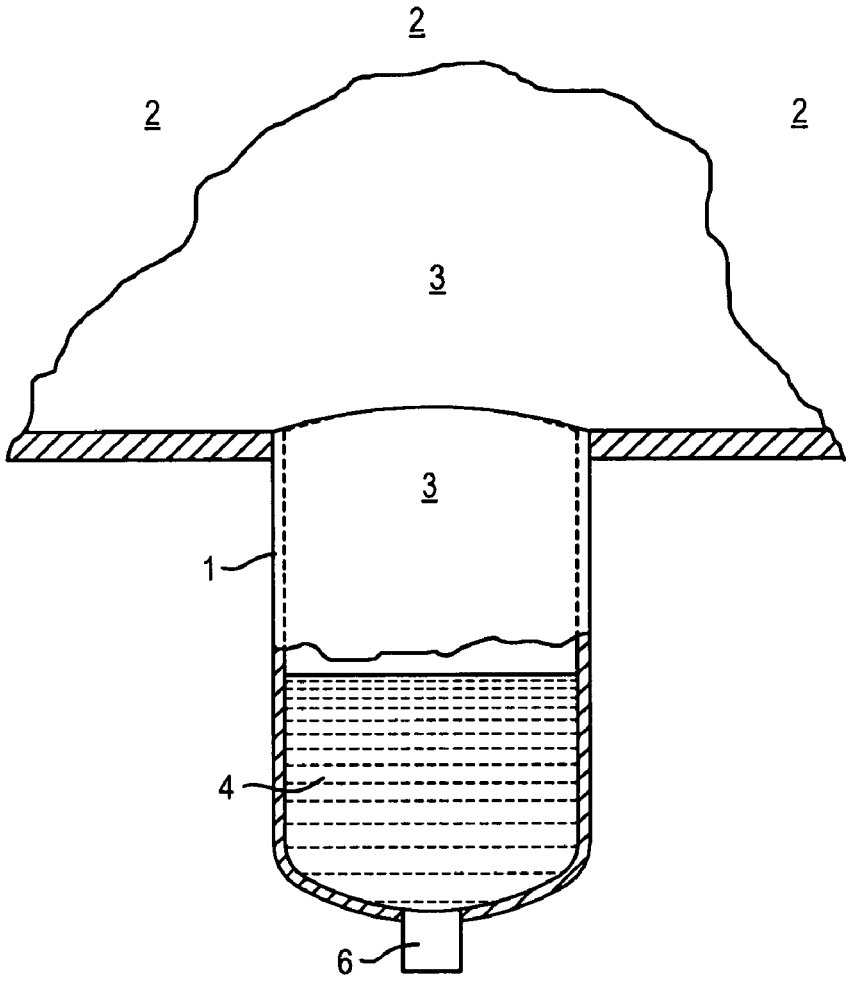
FIG. 1 shows the oil accumulation trap for a generalized flooded ammonia evaporator or a low-pressure receiver.
Figure 2:
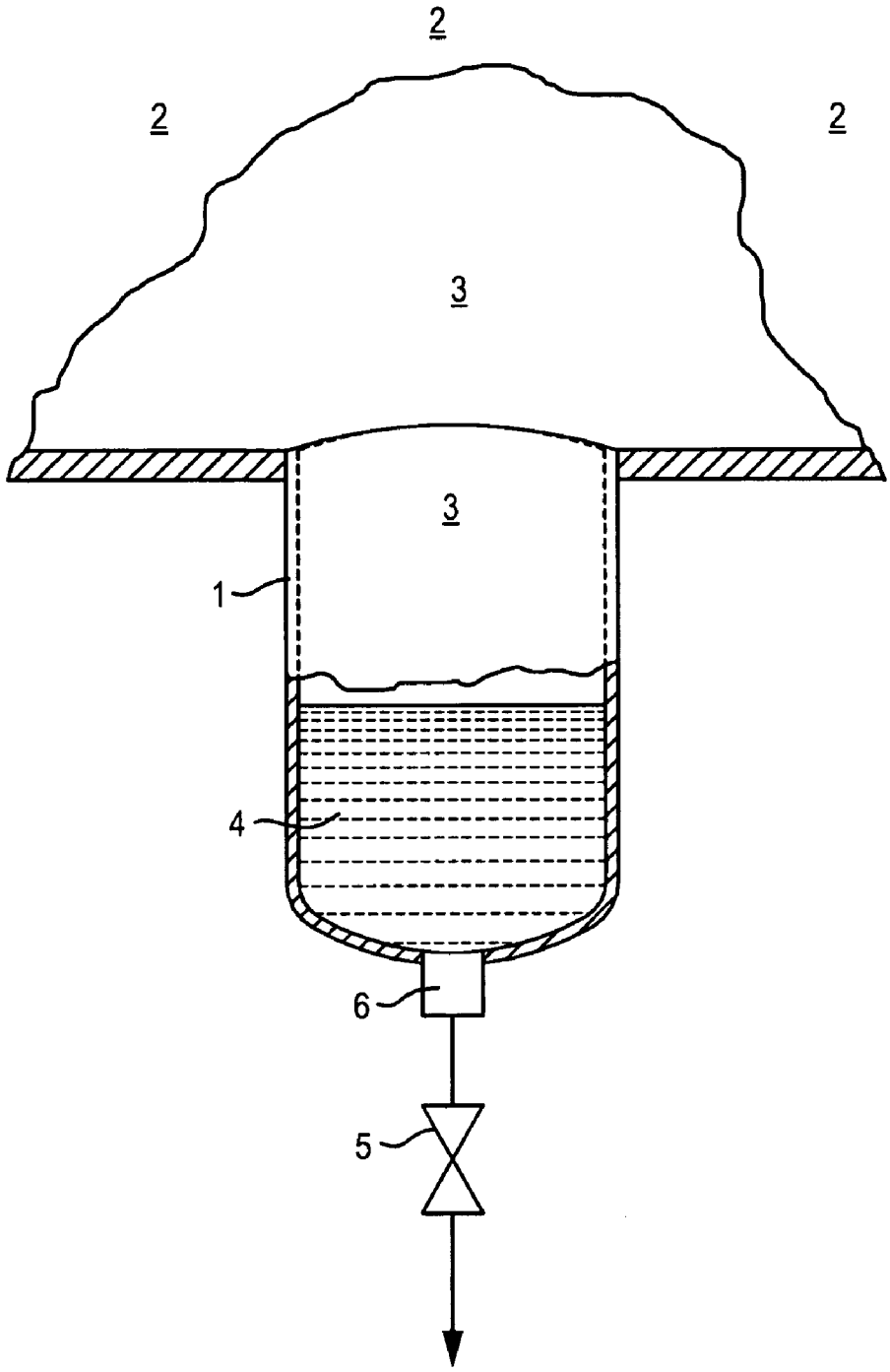
FIG. 2 shows FIG. 1 set-up with a manual valve for oil draining.
Figure 3:
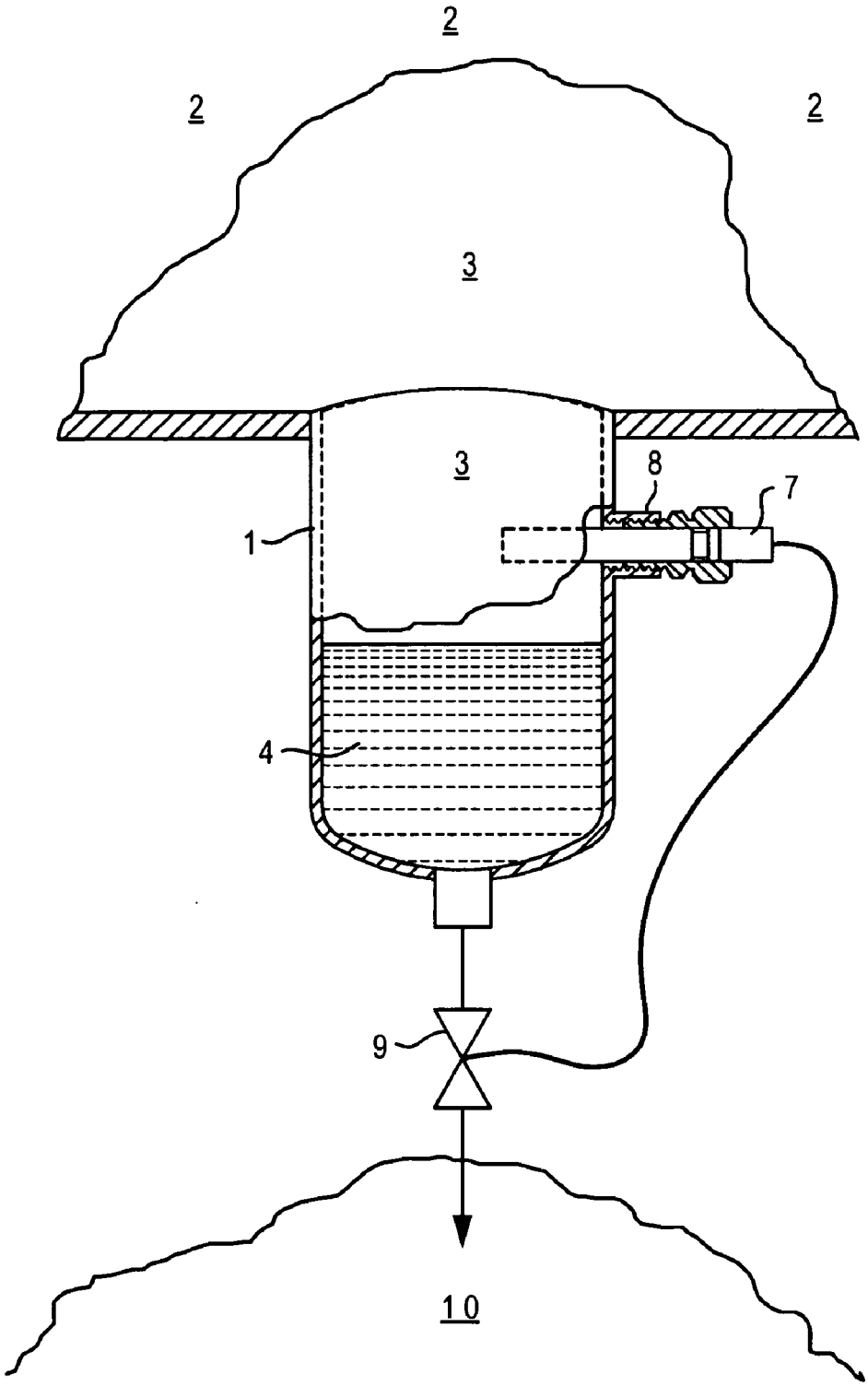
FIG. 3 shows FIG. 1 set-up with an automatic oil removal apparatus as presented in this disclosure.

FIG. 1 shows a typical oil trap 1(sump) in an ammonia refrigeration system. Trap 1 is a part of a flooded evaporator or a low-pressure receiver 2, not shown in detail, since it is assumed that a person familiar with the subject understands the concept of industrial refrigeration. This in turn will reduce unnecessary repetitive commentary on the ammonia refrigeration system and its various components. The flooded evaporator 2 could be a shell and tube, a plate and frame or a shell and plate type. Since mineral oil 4 is heavier than ammonia 3, therefore it always settles down at the bottom. It also does not mix with ammonia. Because of this unique ammonia/oil feature, oil could easily be drained at the lowest point via a manual valve 5 attached to the oil trap 1 at port 6 as shown in FIG. 2. For obvious reasons this is not a very safe, economical or efficient way to purge oil from an ammonia refrigeration system. Therefore, FIG. 3 shows a preferred embodiment where an electric heater type level controller 7 with an extended probe is used to purge oil 4 from an oil trap 1 in an ammonia evaporator or low-pressure receiver. Level controller 7 penetrates trap 1 via port 8. When the oil 4 level rises in trap 1 until it reaches the probe 7, which is in horizontal position and has an electric heater, at that instant it is not fully capable of dissipating the heat from the heater due to the inferior thermal conductivity of oil 4 and therefore signals the valve 9 to open. Once the valve 9 is open the oil drains out of trap 1 until the probe is again in contact with liquid ammonia 3. Liquid ammonia 3 has higher thermal conductivity and hence easily dissipates the heat from the heater. At this juncture the probe signals the valve 9 to shut off. This process is repeated and is totally automatic. The drained oil could be transferred to section 10 that could be an intermediate vessel or a crankcase of a compressor or any other part of a refrigeration system where the oil needs to be transferred.

What is claimed is:

1. An apparatus for removing oil in an ammonia refrigeration system, comprising:

a) a vessel structured and arranged to receive ammonia and any oil circulating in the system;

b) a sump located in a bottom of the vessel;

c) the sump having an outlet connected to a compressor crankcase, with the outlet having a valve;

d) a thermal conductivity sensor located in the sump and above the outlet, the sensor connected to and controlling the valve.

2. The apparatus of claim 1 wherein the outlet is connected to a compressor crankcase by way of an intermediate vessel.

3. The apparatus of claim 1 wherein the thermal conductivity sensor is located a distance above the outlet so that an oil-ammonia interface in the sump can move above and below the sensor.

4. A method of removing oil in an ammonia refrigeration system, comprising the steps of:

a) trapping the oil and ammonia in a sump;

b) at a location in the sump, sensing the thermal conductivity of fluid within the sump;

c) if the thermal conductivity is low, a high level of oil in the sump is indicated, and an outlet in the sump is opened to remove oil from the sump;

d) if the thermal conductivity is high, a low level of oil in the sump is indicated, and the sump outlet is closed.

5. The method of claim 4 wherein the step of sensing the thermal conductivity of fluid within the sump occurs continuously so that after the outlet is opened, the outlet is then closed when the level of oil drops in the sump.

* * * * *